US006170655B1

(12) United States Patent
Hill

(10) Patent No.: US 6,170,655 B1
(45) Date of Patent: Jan. 9, 2001

(54) SMOKING CONTAINER SYSTEM

(76) Inventor: Chrisjon Hill, 1324 Central Ave., Sarasota, FL (US) 34236

( * ) Notice: Under 35 U.S.C. 154(b), the term of this patent shall be extended for 0 days.

(21) Appl. No.: 09/368,177

(22) Filed: Aug. 4, 1999

(51) Int. Cl.[7] ..... B65D 69/00
(52) U.S. Cl. ..... 206/237; 206/247; 131/329
(58) Field of Search ..... 131/329; 150/114; 206/38, 247, 260, 268, 273, 274, 86, 91, 90, 94, 271; 229/5.83, 76, 87.5; 493/189, 261

(56) References Cited

U.S. PATENT DOCUMENTS 4,775,094 * 10/1988 Eisele ..... 229/69
5,301,805 * 4/1994 Evers et al. ..... 206/273

* cited by examiner

*Primary Examiner*—Stanley S. Silverman
*Assistant Examiner*—Robert McBride

(57) ABSTRACT

A smoking container system has an exterior face and an interior face and an upper end and a lower end; a rectangular rear panel with lateral tabs and fold lines there between; a rectangular front panel with lateral tabs and parallel score lines there between; a small rectangular bottom with closely spaced parallel fold lines coupling the front panel and the rear panel; an upper end tab coupled to the upper end of the front panel and with transverse score lines there between; a rectangular closure panel; a small rectangular top formed with closely spaced transverse fold lines coupling the rear panel and the flap panel; a rectangular tear away panel formed with transverse parallel perforations; and a small rectangular spacer formed with closely spaced transverse fold lines coupling the tear away panel and the closure panel.

1 Claim, 3 Drawing Sheets

FIG 5
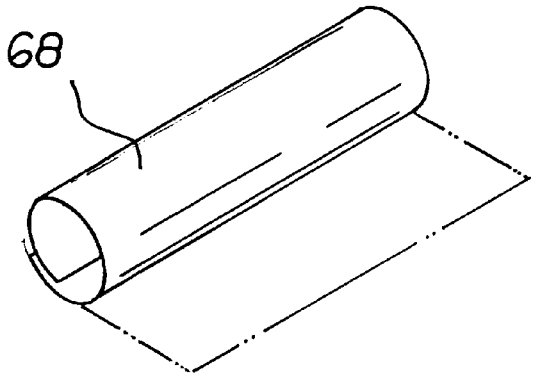
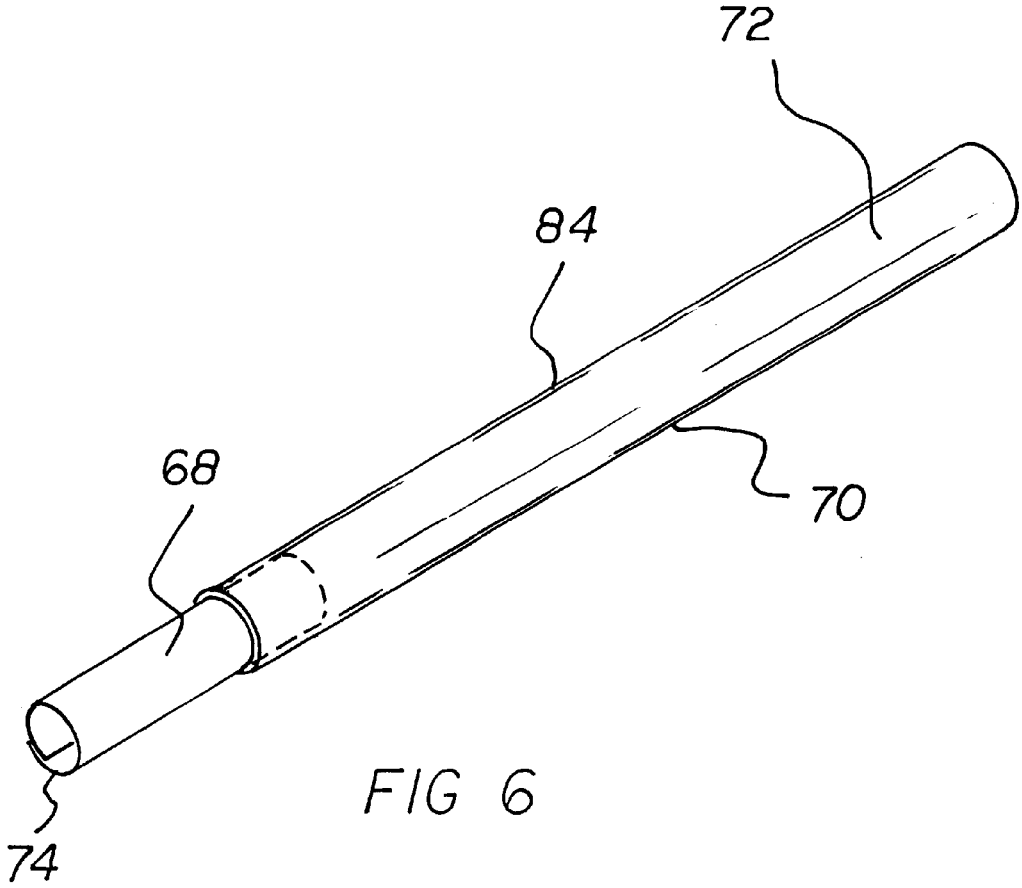
FIG 6

SMOKING CONTAINER SYSTEM

BACKGROUND OF THE INVENTION

1. Field of the Invention

The present invention relates to a smoking container system and more particularly pertains to conveniently retaining tear away cigarette inserts and cigarette rolling paper for use by a smoker.

2. Description of the Prior Art

The use of smoking devices including paper holders and tobacco containers of known designs and configurations is known in the prior art. More specifically, smoking devices including paper holders and tobacco containers of known designs and configurations heretofore devised and utilized for the purpose of supporting smoking related implements in convenient packaging systems through known methods and configurations are known to consist basically of familiar, expected, and obvious structural configurations, notwithstanding the myriad of designs encompassed by the crowded prior art which has been developed for the fulfillment of countless objectives and requirements.

While prior devices fulfill their respective, particular objectives and requirements, the prior art does not describe a smoking container system that allows conveniently retaining tear away cigarette inserts and cigarette rolling paper for use by a smoker.

In this respect, the smoking container system according to the present invention substantially departs from the conventional concepts and designs of the prior art, and in doing so provides an apparatus primarily developed for the purpose of conveniently retaining tear away cigarette inserts and cigarette rolling paper for use by a smoker.

Therefore, it can be appreciated that there exists a continuing need for a new and improved smoking container system which can be used for conveniently retaining tear away cigarette rolling paper for use by a smoker. In this regard, the present invention substantially fulfills this need.

SUMMARY OF THE INVENTION

In view of the foregoing disadvantages inherent in the known types of smoking devices including paper holders and tobacco containers of known designs and configurations now present in the prior art, the present invention provides an improved smoking container system. As such, the general purpose of the present invention, which will be described subsequently in greater detail, is to provide a new and improved smoking container system and method which has all the advantages of the prior art and none of the disadvantages.

To attain this, the present invention essentially comprises a sheet of relatively stiff cardboard-like material has an exterior face and an interior face. The sheet also has an upper end and a lower end. The sheet has a height of about 12.75 inches. The sheet has a maximum width of about 3.25 inches and a minimum width of about 1.50 inches. The sheet has a rectangular rear panel. The rear panel has a height of about 2.75 inches and a width of about 1.75 inches. Lateral tabs are provided on the rear panel. Fold lines are provided between the tabs and the rear panel. Transverse slits are provided at equally spaced locations across the rear panel. The sheet also has a rectangular front panel. The front panel has a height of about 2.75 inches and a width of about 1.75 inches. Lateral tabs are provided on the front panel. Parallel score lines are provided between the tabs and the front panel. The sheet also has a small rectangular bottom. Closely spaced parallel fold lines couple the front panel and the rear panel. The bottom is adapted to position the front and rear panels in spaced parallel relationship to form a pocket between the front panel and rear panel. The sheet also has an upper end tab coupled to the upper end of the front panel. Transverse score lines are provided between the upper end tab and the front panel. The sheet also has a rectangular closure panel. The closure panel has a height of about 2.75 inches and a width of about 1.75 inches. The sheet also has a small rectangular top. The top couples the rear panel and the flap panel. Closely spaced transverse fold lines are provided between the tap and the rear panel and the top and the flap panel. The top is adapted to position the closure panel over the front panel in parallel relationship for covering the pocket. The sheet also has a rectangular tear away panel. The tear away panel has a height of about 2.75 inches and a width of about 1.50 inches. Transverse parallel perforations are provided. The tear away panel is positionable in the slits for retention purposes. In this manner, individual segments may be torn off. The torn off individual segment may then be rolled up and inserted into a cigarette between tobacco and the end held by a user's mouth. The use of the rolled up segment results in reduced waste of tobacco and tobacco is kept out of a user's mouth. The sheet also has a small rectangular spacer coupling the tear away panel and the closure panel. Closely spaced transverse fold lines are provided between the spacer and the tear away panel and between the spacer and the closure panel. A plurality of papers are positioned in the pocket between the front panel and the rear panel when folded together. An opening formed above the pocket is adapted to be closed and opened by the folding over and folding back of the closure panel.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved smoking container system which has all of the advantages of the prior art smoking devices including paper holders and tobacco containers of known designs and configurations and none of the disadvantages.

It is another object of the present invention to provide a new and improved smoking container system which may be easily and efficiently manufactured and marketed.

It is further object of the present invention to provide a new and improved smoking container system which is of durable and reliable constructions.

An even further object of the present invention is to provide a new and improved smoking container system which is susceptible of a low cost of manufacture with regard to both materials and labor, and which accordingly is then susceptible of low prices of sale to the consuming public, thereby making such smoking container system economically available to the buying public.

Even still another object of the present invention is to provide a smoking container system for conveniently retaining tear away cigarette inserts and cigarette rolling paper for use by a smoker.

Lastly, it is an object of the present invention to provide a new and improved smoking container system having an exterior face and an interior face and an upper end and a lower end; a rectangular rear panel with lateral tabs and fold lines there between and with transverse slits at equally spaced locations there across; a rectangular front panel with lateral tabs and parallel score lines there between; a small rectangular bottom with closely spaced parallel fold lines coupling the front panel and the rear panel; an upper end tab coupled to the upper end of the front panel and with transverse score lines there between; a rectangular closure panel; a small rectangular top formed with closely spaced transverse fold lines coupling the rear panel and the flap panel; a rectangular tear away panel formed with transverse parallel perforations positionable in the slits; and a small rectangular spacer formed with closely spaced transverse fold lines coupling the tear away panel and the closure panel.

These together with other objects of the invention, along with the various features of novelty which characterize the invention, are pointed out with particularity in the claims annexed to and forming a part of this disclosure. For a better understanding of the invention, its operating advantages and the specific objects attained by its various uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a perspective illustration of one of the segments of the tear away panel shown in the prior figures, but in a rolled up configuration ready for insertion in a cigarette.

FIG. 6 is a rolled cigarette with tobacco and a segment positioned within a rolled cylindrical cigarette paper.

The same reference numerals refer to the same parts throughout the various Figures.

DESCRIPTION OF THE PREFERRED EMBODIMENT

Figure 1:
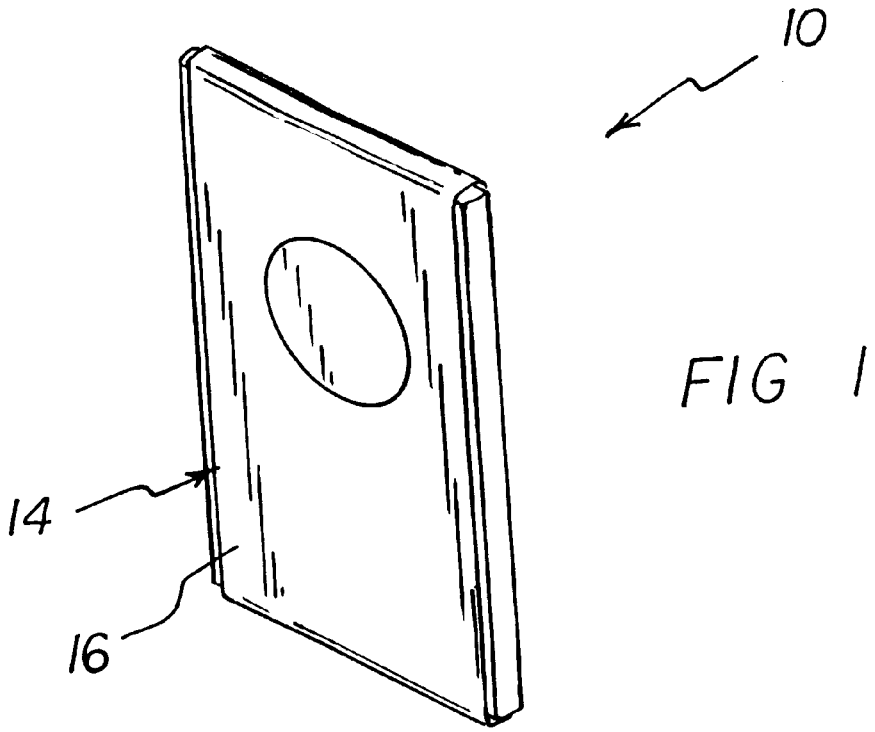
FIG. 1 is a perspective illustration of the front of the smoking container system constructed in accordance with the principles of the present invention.

With reference now to the drawings, and in particular to FIG. 1 thereof, the preferred embodiment of the new and improved smoking container system embodying the principles and concepts of the present invention and generally designated by the reference numeral 10 will be described.

The present invention, the smoking container system 10 is comprised of a plurality of components. Such components in their broadest context include a sheet formed with a rectangular rear panel, a rectangular front panel, a small rectangular bottom, an upper end tab, a rectangular closure panel, a small rectangular top, a rectangular tear away panel, and a small rectangular spacer. Such components are individually configured and correlated with respect to each other so as to attain the desired objective.

A sheet 14 of relatively stiff cardboard-like material has an exterior face 16 and an interior face 18. The sheet also has an upper end 20 and a lower end 22. The sheet has a height of about 12.75 inches. The sheet has a maximum width of about 3.25 inches and a minimum width of about 1.50 inches.

The sheet has a rectangular rear panel 26. The rear panel has a height of about 2.75 inches and a width of about 1.75 inches. Lateral tabs 28 are provided on the rear panel. Fold lines 30 are provided between the tabs and the rear panel. Transverse slits 32 are provided at equally spaced locations across the rear panel.

The sheet also has a rectangular front panel 36. The front panel has a height of about 2.75 inches and a width of about 1.75 inches. Lateral tabs 38 are provided on the front panel. Parallel score lines 40 are provided between the tabs and the front panel.

The sheet also has a small rectangular bottom 44. Closely spaced parallel fold lines 46 couple the front panel and the rear panel. The bottom is adapted to position the front and rear panels in spaced parallel relationship to form a pocket between the front panel and rear panel.

The sheet also has an upper end tab 50 coupled to the upper end of the front panel. Transverse score lines 52 are provided between the upper end tab and the front panel.

The sheet also has a rectangular closure panel 56. The closure panel has a height of about 2.75 inches and a width of about 1.75 inches.

The sheet also has a small rectangular top 58. The top couples the rear panel and the flap panel. Closely spaced transverse fold lines 60 are provided between the tap and the rear panel and the top and the flap panel. The top is adapted to position the closure panel over the front panel in parallel relationship for covering the pocket.

The sheet also has a rectangular tear away panel 64. The tear away panel has a height of about 2.75 inches and a width of about 1.50 inches. Transverse parallel perforations 66 are provided. The tear away panel is positionable in the slits for retention purposes. In this manner, individual segments may be torn off. The torn off individual segment may then be rolled up and inserted into a cigarette 70 between tobacco 72 and the end 74 held by a user's mouth. The use of the rolled up segment results in reduced waste of tobacco and tobacco is kept out of a user's mouth. The rolled up segment is also believed to have filtration benefits.

The sheet also has a small rectangular spacer 78 coupling the tear away panel and the closure panel. Closely spaced transverse fold lines 80 are provided between the spacer 78 and the tear away panel 64 and between the spacer 78 and the closure panel 56.

Figure 2:
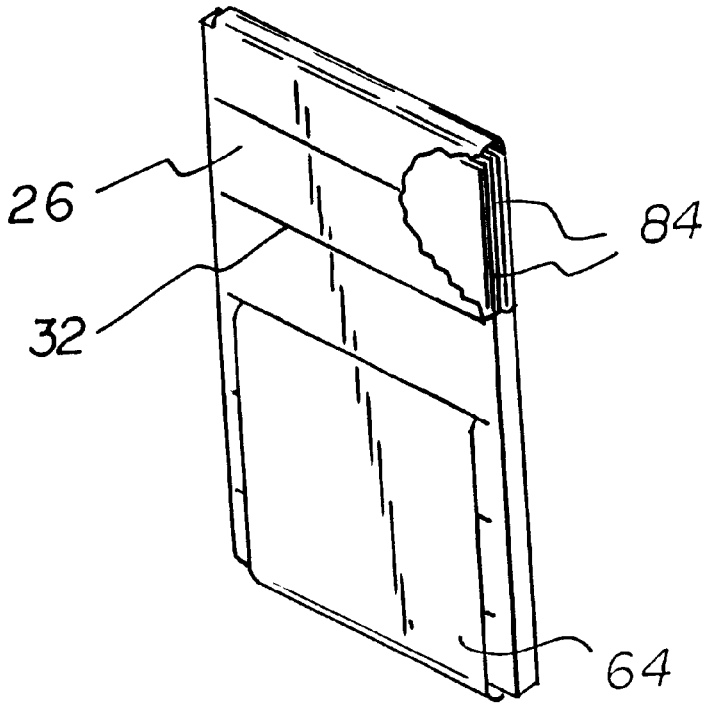
FIG. 2 is a rear perspective view of the system shown in FIG. 1, but with parts removed to show certain internal constructions thereof.
Figure 3:
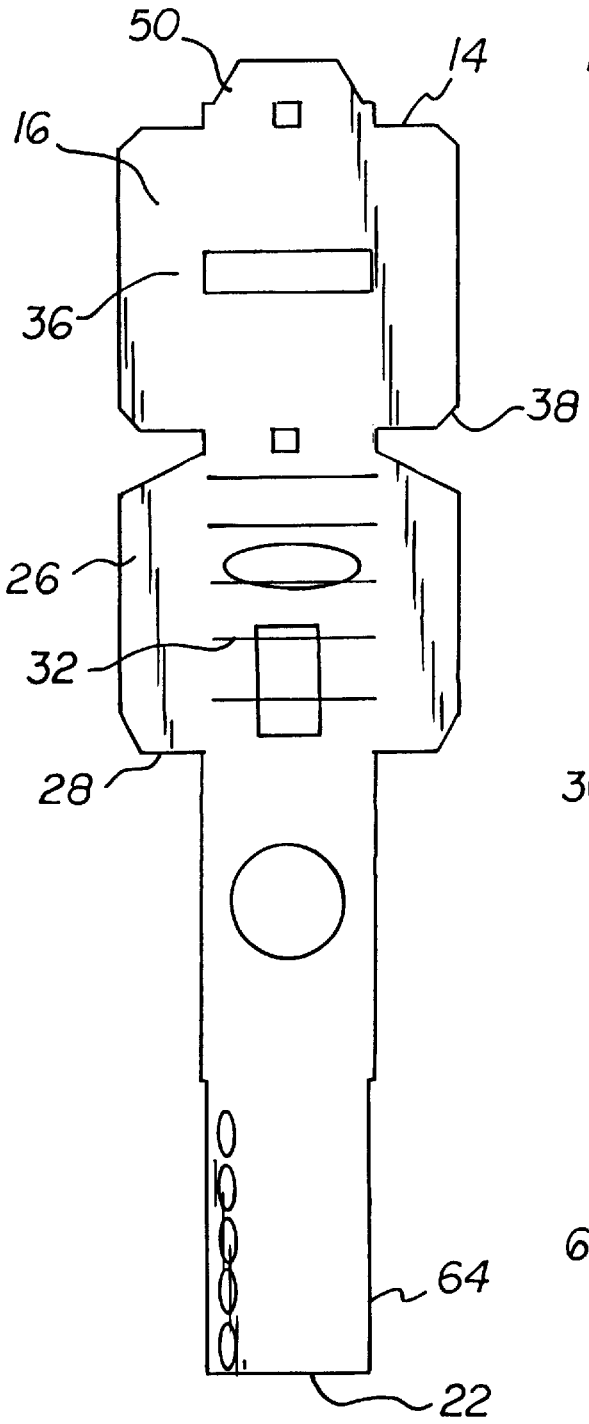
FIGS. 3 and 4 are front and rear elevational views of the sheet materials used to construct the material of FIGS. 1 and 2.
Figure 4:
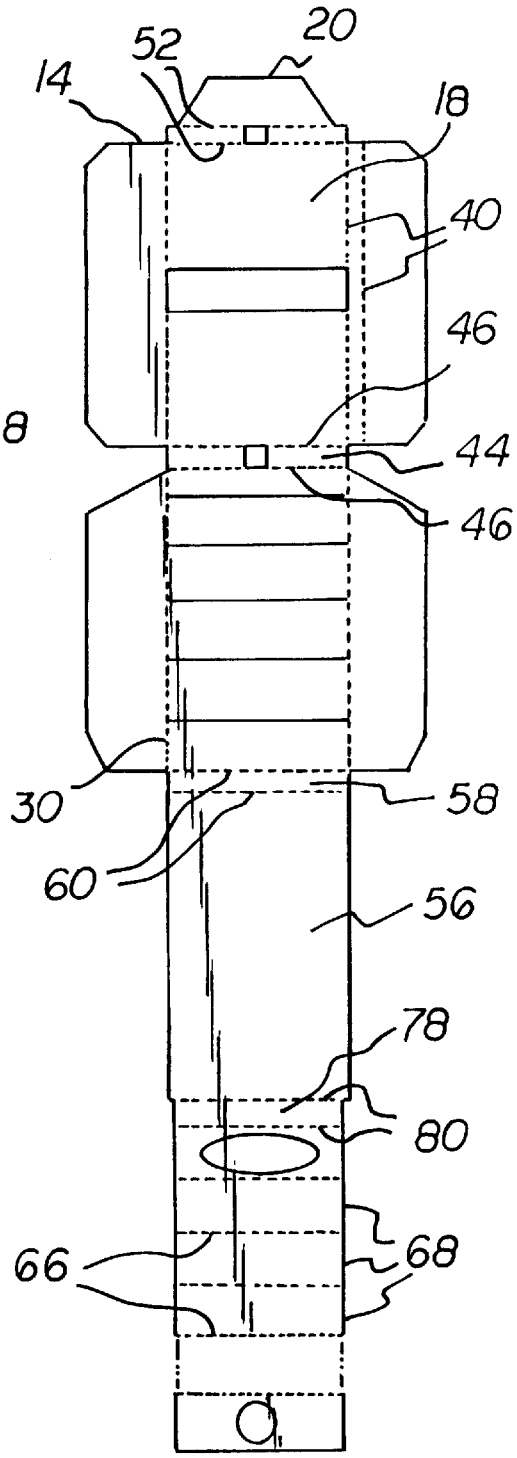

The flat sheet, as shown in FIGS. 3 and 4, is held in the operative configuration, as shown in FIGS. 1 and 2, through two patches of glue. With the tabs of the rear panel folded into planar contact with the rear panel, and with the tabs of the front panel parallel with the front panel, but spaced by the fold lines there between, glue will contact and couple the tabs of the front and rear panels to hold the sheet in a rectilinear configuration, a box. All the panels are thus co-planar with the space there between being effected by the top and the bottom and the spaces between the fold lines on the sides of the front panel which constitute sides.

A plurality of papers 84 are or alternatively a length of paper is positioned in the pocket between the front panel and the rear panel when folded together. Like the material of the sheet, the papers are preferably fabricated of natural products, not trees, and are of an easily rolled consistency, a lighter heft than the sheet. An opening formed above the pocket is adapted to be closed and opened by the folding over and folding back of the closure panel. As the free end of the tear away panel becomes shortened through the tearing off of the individual segments for use, the free end of the tear away panel will be inserted in an appropriate associated adjacent slit on the back panel. Such insertion will secure the closure panel and tear away panels with respect to the box to assist in transportation and storage. In addition, the upper end tab also functions as a lid, a primary lid for the box.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved smoking container system for the convenient retention of tear-away cigarette inserts and with a space for cigarette rolling paper comprising, in combination:

a sheet of relatively stiff cardboard-like material having an exterior face and an interior face and with an upper end and a lower ends the sheet having a height of about 12.75 inches and a maximum width of about 3.25 inches and a minimum width of about 1.50 inches;

the sheet having a rectangular rear panel having a height of about 2.75 inches and a width of about 1.75 inches with lateral tabs and fold lines there between and with transverse slits at equally spaced locations there across;

the sheet also having a rectangular front panel having a height of about 2.75 inches and a width of about 1.75 inches with lateral tabs and parallel score lines there between;

the sheet also having a small rectangular bottom with closely spaced parallel fold lines coupling the front panel and the rear panel and adapted to position the front and rear panels in spaced parallel relationship to form a pocket there between;

the sheet also having an upper end tab coupled to the upper end of the front panel and with transverse score lines there between;

the sheet also having a rectangular closure panel having a height of about 2.75 inches and a width of about 1.75 inches;

the sheet also having a small rectangular top formed with closely spaced transverse fold lines coupling the rear panel and the closure panel and adapted to position the closure panel over the front panel in parallel relationship for covering the pocket;

the sheet also having a rectangular tear away panel having a height of about 2.75 inches and a width of about 1.50 inches and formed with transverse parallel perforations wherein the tear away panel is positionable in the slits for position retention purposes and adapted to allow the tearing off of individual segments for being rolled up and inserted into a cigarette between tobacco and the end held by a user's mouth to stop waste and keep tobacco out of a user's mouth;

the sheet also having a small rectangular spacer formed with closely spaced transverse fold lines coupling the tear away panel and the closure panel; and a plurality of papers positioned in the pocket between the front panel and the rear panel when folded together with an opening there above adapted to be closed and opened by the folding over and folding back of the closure panel.

* * * * *